US007691043B2

(12) United States Patent
Lanier, Jr. et al.

(10) Patent No.: US 7,691,043 B2
(45) Date of Patent: Apr. 6, 2010

(54) METHOD AND APPARATUS FOR MAKING CIGARETTE FILTERS WITH A CENTRALLY LOCATED FLAVORED ELEMENT

(75) Inventors: Robert C. Lanier, Jr., Moseley, VA (US); Steven M. Campbell, Mechanicsville, VA (US); Stephen J. Bellamah, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 573 days.

(21) Appl. No.: 11/188,958

(22) Filed: Jul. 26, 2005

(65) Prior Publication Data

US 2005/0255978 A1 Nov. 17, 2005

Related U.S. Application Data

(62) Division of application No. 10/397,275, filed on Mar. 27, 2003, now Pat. No. 7,074,170.

(60) Provisional application No. 60/368,376, filed on Mar. 29, 2002.

(51) Int. Cl.
*B31C 99/00* (2006.01)

(52) U.S. Cl. ..... 493/44; 493/39; 493/50; 493/4

(58) Field of Classification Search ..... 493/44, 493/39, 50, 941, 4, 40, 42, 45, 20
See application file for complete search history.

(56) References Cited

U.S. PATENT DOCUMENTS

| | | | |
|---|---|---|---|
| 884,982 | A | 4/1908 | De Lery |
| 3,016,945 | A | 1/1962 | Wexler |
| 3,068,873 | A | 12/1962 | Allman, Jr. et al. |
| 3,144,024 | A | 8/1964 | Eichwald et al. |
| 3,162,199 | A | 12/1964 | Moll, Jr. |
| 3,313,306 | A | 4/1967 | Berger et al. |
| 3,339,558 | A | 9/1967 | Waterbury |

(Continued)

OTHER PUBLICATIONS

Notification of Transmittal of the International Search Report for PCT/US03/09648 dated Aug. 22, 2003.

(Continued)

*Primary Examiner*—Sameh H. Tawfik
(74) *Attorney, Agent, or Firm*—Buchanan Ingersoll & Rooney PC

(57) ABSTRACT

A filter making apparatus includes a positioning device having a passageway therethrough, with the passageway guiding a continuous flavor element such as a continuous strand of textile material from an inlet of the passageway to an outlet of the passageway. A liquid flavorant is introduced into the passageway at a desired flow rate and the strand of material carries the supplied liquid flavorant out of the positioning device at a rate substantially equal to the desired flow rate. A portion of the passageway can form a bath of the liquid flavorant supplied to the passageway through a separate inlet at approximately atmospheric pressure. A portion of the positioning device guides the continuous strand of material through the bath, or guides the strand to pass along the bottom of the passageway, and the saturated or partially saturated strand of material then exits from an outlet of the passageway to a point in the path of filter tow material that is being converged to form a filter rod.

6 Claims, 7 Drawing Sheets

U.S. PATENT DOCUMENTS 3,397,700 A 8/1968 Harlow et al.
3,422,819 A 1/1969 Jones et al.
3,546,325 A * 12/1970 Muller ..... 264/45.9
3,637,447 A 1/1972 Berger et al.
3,683,936 A 8/1972 O'Neil, Jr.
3,779,787 A 12/1973 Haslam et al.
3,837,264 A 9/1974 Sexstone
3,847,064 A 11/1974 Berger
3,853,039 A 12/1974 Haslam et al.
4,034,765 A * 7/1977 Hall ..... 131/336
4,179,323 A 12/1979 Sigmon
4,189,511 A 2/1980 Levers et al.
4,211,741 A * 7/1980 Ostoich ..... 264/171.26
4,236,532 A 12/1980 Schweizer et al.
4,281,671 A 8/1981 Bynre et al.
4,291,711 A 9/1981 Berger
4,355,995 A 10/1982 Berger
4,522,616 A 6/1985 Hyde et al.
4,537,583 A 8/1985 Pryor
4,549,875 A 10/1985 Pryor
4,655,229 A 4/1987 Sensabaugh, Jr. et al.
4,661,090 A 4/1987 Arthur
4,676,769 A * 6/1987 Bahr et al. ..... 493/4
4,677,995 A 7/1987 Kallianos et al.
4,744,932 A 5/1988 Browne
4,768,526 A 9/1988 Pryor
4,798,090 A 1/1989 Heath et al.
4,798,570 A 1/1989 Jarkiewitsch
4,971,078 A 11/1990 Deutsch et al.
5,012,829 A 5/1991 Thesing et al.
5,144,967 A 9/1992 Cartwright et al.
5,190,061 A 3/1993 Brackmann et al.
5,269,329 A 12/1993 Geer et al.
5,387,285 A * 2/1995 Rivers ..... 118/325
5,415,189 A 5/1995 Sampson et al.
5,725,467 A * 3/1998 Chehab et al. ..... 493/42
6,903,555 B2 * 6/2005 Gill et al. ..... 324/464

OTHER PUBLICATIONS

Notification of Transmittal of International Preliminary Examination Report dated Feb. 9, 2004 for PCT/US03/09648.

* cited by examiner

METHOD AND APPARATUS FOR MAKING CIGARETTE FILTERS WITH A CENTRALLY LOCATED FLAVORED ELEMENT

This application is a divisional application of U.S. application Ser. No. 10/397,275 entitled METHOD AND APPARATUS FOR MAKING CIGARETTE FILTERS WITH A CENTRALLY LOCATED FLAVORED ELEMENT, filed on Mar. 27, 2003, now U.S. Pat. No. 7,074,170 which claims the benefit of U.S. Provisional Application No. 60/368,376, filed Mar. 29, 2002, the entire contents of which are hereby incorporated by reference.

FIELD OF THE INVENTION

This invention relates to methods and apparatus for making cigarette filters that incorporate a centrally located flavored element which affects the taste of smoke drawn through the filter.

BACKGROUND OF THE INVENTION

Tobacco smoke filters have been produced that incorporate a flavor agent where the agent is applied uniformly over the filtering material before the filtering material is gathered and shaped to form the filter product. An example of these conventional filters includes a flavored tobacco smoke filter made from bonded cellulose acetate filamentary tow in which a liquid plasticizer such as triacetin is sprayed uniformly over the tow before it is gathered to its final rod form. The flavoring agent is normally dissolved in the liquid plasticizer, and the plasticizer effects the bonding between adjacent filaments.

Other methods of producing cigarette filters are disclosed in U.S. Pat. Nos. 4,549,875, 4,768,526 and 4,281,671.

It has been found in practicing the conventional methods for producing tobacco smoke filters that problems result when the use of a particular flavoring agent is to be terminated or when one flavoring agent is to be substituted for another. These problems result because the spray booth within which the plasticizer is applied will be contaminated with the first flavoring agent employed, so that the subsequently produced filters would be contaminated unless production was stopped and the contaminated booth was cleaned or replaced.

Known methods for introducing a flavored element into the interior of a filter have also suffered from the disadvantage that flavorant is often not introduced in the proper amounts or at the proper location within the cigarette filter to achieve the desired effect on the smoke passing through the filter, and the position of the flavored element within the smoke filter could not be precisely controlled.

SUMMARY OF THE INVENTION

In view of the disadvantages of prior art systems for producing filters, and in particular tobacco smoke filters, a method of continuously producing tobacco smoke filter rod according to the invention includes advancing a supply of filter tow material, converging the advancing filter tow material to a rod form, passing a flavor element, such as a continuous line of textile material, through a positioning device for entraining the flavor element with the advancing filter tow material at a point during the converging of the filter tow material to a rod form, and supplying a liquid flavorant at approximately atmospheric pressure to the positioning device to partially fill the positioning device. In one embodiment, a bath of the liquid flavorant is formed within a passageway in the positioning device and the flavor element is passed through the bath of flavorant before being entrained in the advancing filter tow material. The continuous flavor element is preferably at least one yarn or other material having the quality of absorbing the maximum amount of liquid flavorant and carrying the flavorant with the flavor element to be positioned centrally within the completed filter rod.

The positioning device can be configured and positioned relative to equipment designed for converging filter tow into a filter rod such that a first portion of the positioning device forms a bath of the liquid flavorant while a second portion of the positioning device directs the continuous textile material into the bath before the textile material exits from the outlet of the positioning device.

The positioning device is preferably provided with at least first and second inlets, with the continuous flavor element passing through the first inlet and the liquid flavorant being supplied through the second inlet. In a preferred embodiment, the positioning device is configured with a bend or "goose-neck" near the first inlet such that the continuous flavor element, in passing through the goose-neck, is maintained at the bottom of the positioning device for the rest of the way to the exit. This ensures that the flavor element will remain in the liquid flavorant that collects in the bottom of the positioning device, or is provided at an intermediate point along the passageway through the device.

The liquid flavorant is preferably supplied at a desired rate into the positioning device through the second inlet, which can be positioned at an end of the device or at some intermediate, downstream point, using a metering pump while the continuous flavor element is introduced into the positioning device through the first inlet. The liquid flavorant is partially absorbed by the textile material and/or adheres to the textile material by surface tension such that the textile material and the flavorant travel through the positioning device toward the outlet of the passageway through the positioning device, which is positioned in the path of the filter tow material at a point downstream of at least a portion of a converging device that funnels the filter tow material into a rod form. Preferably, the flavor element is at least partially saturated by the liquid flavorant as it passes through the bath, or as the flavor element travels along the bottom of the passageway downstream from the inlet for liquid flavorant.

In the case of traditional filter making equipment, the outlet of the positioning device can be positioned under the tongue, which is positioned downstream of a transport jet and an air funnel that form part of the converging device. The tongue guides the filter tow material in the final stage before it is converged to a rod form, and the positioning device guides the liquid flavorant and the continuous flavor element to a position relative to the tongue that ensures desired positioning of the continuous length of textile material in the finished filter rod.

The positioning device is preferably tilted upward towards its outlet end when it is assembled with the filter making equipment. The inlet for introduction of liquid flavorant can be positioned along the device at a point downstream from where the flavor element is introduced, or at the same end of the device through a separate inlet. An upstream portion of the positioning device can be configured to form a bath of the liquid flavorant at an intermediate low point of the positioning device. In the embodiment of the device where a bath of flavorant is formed in the device, the continuous flavor element enters the positioning device through an inlet and is preferably guided through the bath of liquid flavorant by a guide portion of the positioning device before exiting from the outlet of the positioning device. The filter tow material that is converging around the outlet of the positioning device underneath the tongue of the filter making equipment pulls the continuous flavor element along with the filter tow material as the tow material continues to move in a downstream direction to be formed into the finished filter rod. The continuous flavor element carries the liquid flavorant as it exits from the outlet of the positioning device.

The rate of movement of the flavor element through the passageway can be synchronized with the rate at which liquid flavorant is introduced into the passageway such that the flavor element can carry all of the liquid flavorant introduced into the device as it passes through the flavorant collecting in the bottom of the device. In an alternative embodiment, a portion of the positioning device can be configured to collect liquid flavorant into a bath through which the flavor element is passed. Preferably, an equilibrium point is reached at which the amount of liquid flavorant being carried by the flavor element is the same amount as is metered into the positioning device. This equilibrium point is maintained and the passageway through the positioning device remains at atmospheric pressure. The metering pump providing liquid flavorant through an inlet of the positioning device is preferably controlled such that the amount of liquid flavorant introduced into the device, or introduced and collected in a bath at the low point of the positioning device, remains substantially the same as the continuous flavor element pulls the liquid flavorant along with it when exiting from the outlet of the positioning device.

The positioning device can be provided with fine-tune adjustments so that its final position relative to the converging filter tow material under the tongue of the filter making equipment can be precisely controlled. It is preferred to locate the continuous flavor element carrying liquid flavorant in the center of the path of maximum air flow through the finished cigarette filter rods. The outlet of the positioning device is preferably provided with a sufficient diameter to allow for passage of the continuous flavor element, such as continuous length of textile material carrying liquid flavorant without creating any undesirable back pressure in the positioning device and yet with the outlet of the positioning device being maintained at a small enough outer diameter such that it does not protrude too far into the path of converging filter tow material at the point where the filter tow material is being shaped by the tongue into the final rod form.

BRIEF DESCRIPTION OF THE DRAWINGS

The invention is illustrated by way of example only with reference to the accompanying drawings, in which.

DESCRIPTION OF THE PREFERRED EMBODIMENTS

Figure 1A:
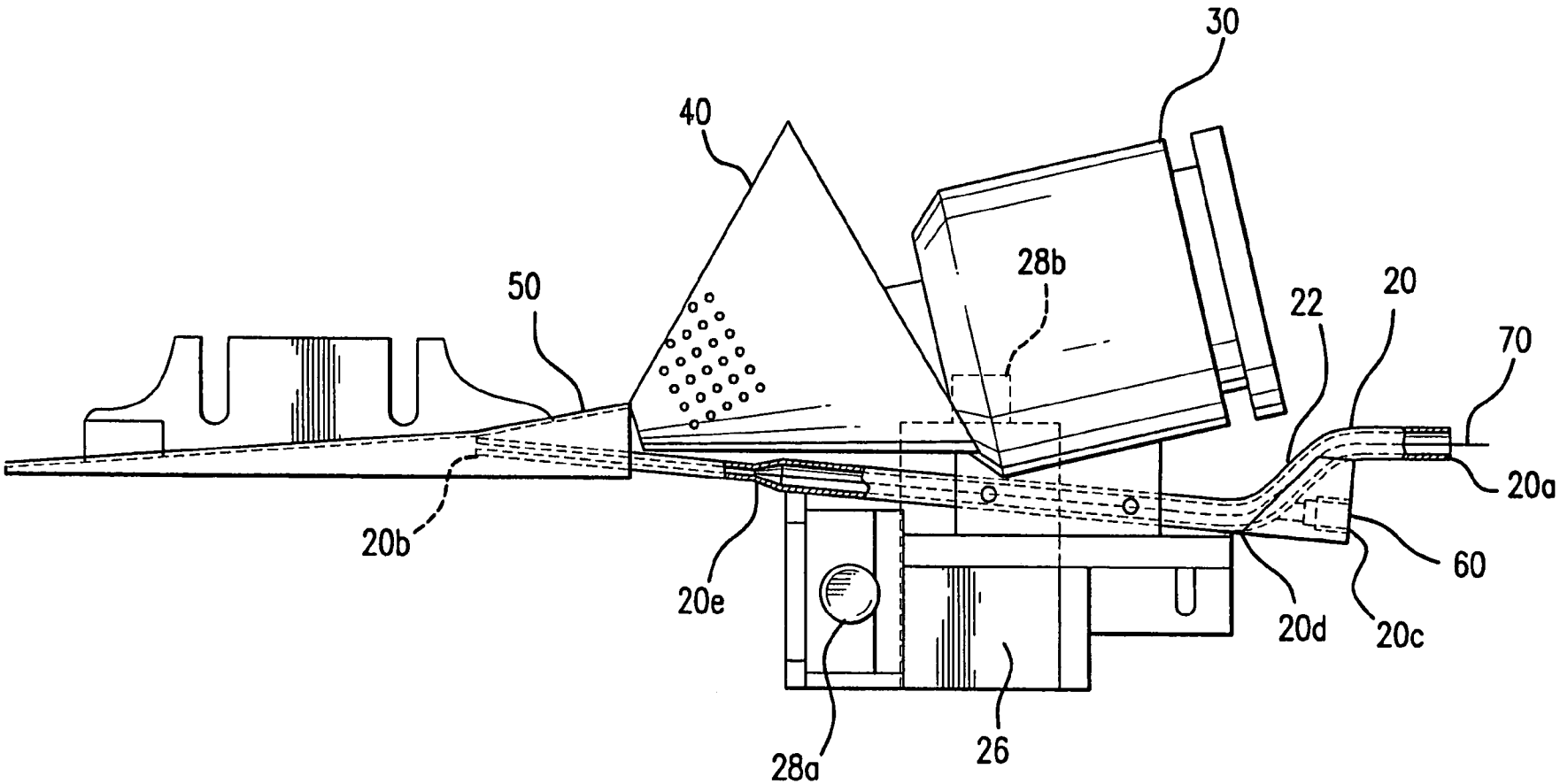
FIG. 1A is a side elevation view of a portion of an apparatus for forming filters including a positioning device according to a first embodiment of the present invention.
Figure 3A:
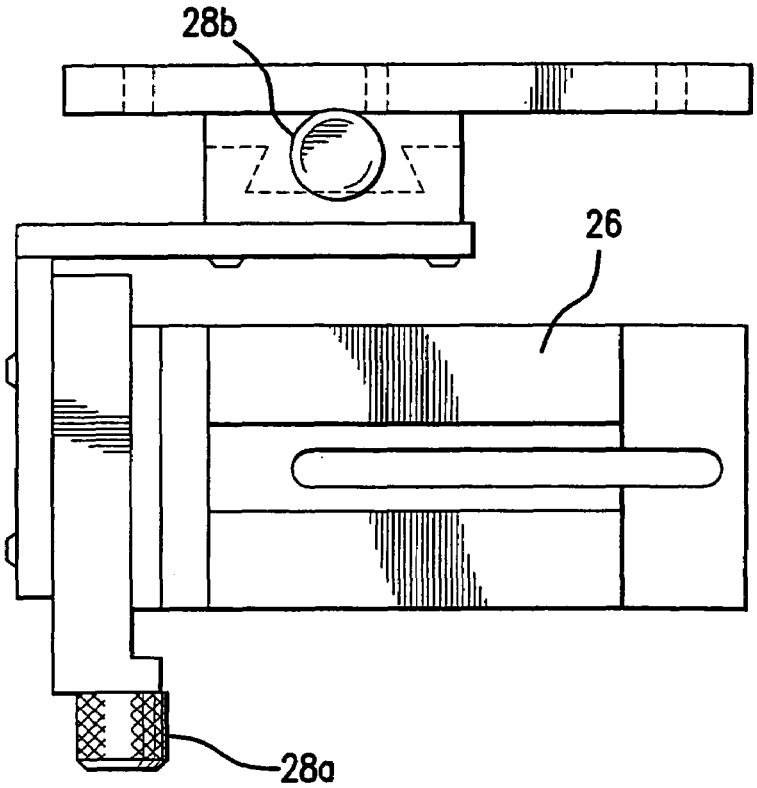
FIGS. 3A and 3B illustrate details of a bracket with horizontal and vertical adjustment knobs for positioning the positioning device.
Figure 3B:
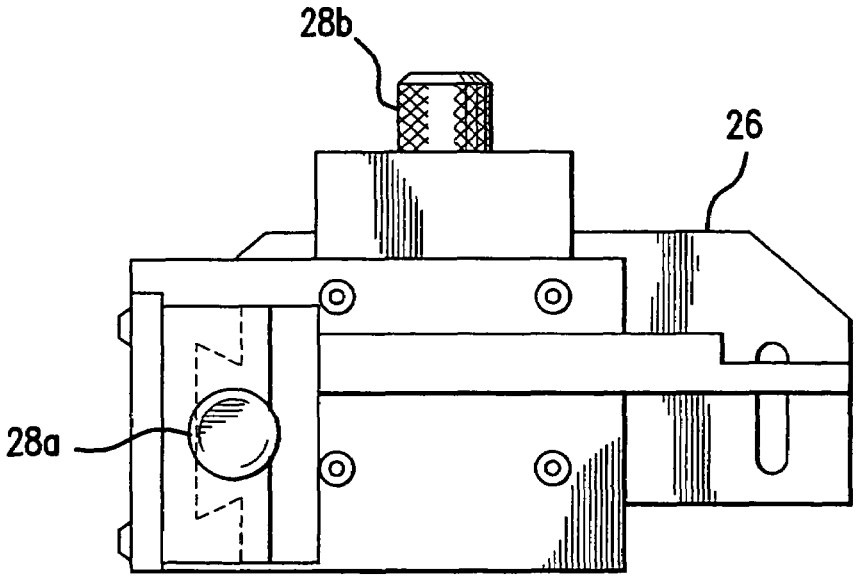

Referring initially to FIG. 1A, an embodiment of a positioning device according to the invention is combined with standard filter making equipment to provide for the positioning of a flavor element 70 that is approximately centered within a filter rod made from filter tow material. The positioning device 20 is located and adjustably positioned relative to the filter making equipment by bracket 26, horizontal adjustment knob 28*a*, and vertical adjustment knob 28*b* as shown in FIGS. 1A, 3A and 3B. The bracket 26 can hold the positioning device 20 in position relative to a transport jet 30 and an air funnel 40, with an outlet end 20*b* of the positioning device 20 being positioned under a tongue 50 that guides converging filter tow material exiting from the air funnel 40 into a standard garniture downstream of the outlet end 20*b* where the filter tow is shaped to rod form. The resulting continuous rod is then wrapped with a filter paper and the wrap is secured with a lapped and adhesively bonded seam.

Filter tow material such as cellulose acetate tow can be drawn from a bale and passed over a series of rollers (not shown) located upstream of the transport jet 30 before the filter tow material begins to be converged by the transport jet 30 and fluffed by the injection of compressed air supplied via a suitable arrangement (not shown) to the transport jet 30. After exiting the outlet end of the transport jet, the fluffed filter tow material is then further converged by the air funnel 40 before entering under the tongue 50.

The positioning device 20 is provided with a first inlet 20*a*, a second inlet 20*c* and the outlet 20*b*. Flavor element 70 can be introduced through the inlet 20*a* and guided by a first portion 22 of the positioning device 20 to a second, lower portion 20*d* of the positioning device 20.

The flavor element can be selected from a variety of materials including, but not limited to, cotton yarn, cellulose acetate, rayon, or other textile or non-textile materials capable of absorbing a liquid flavorant. Although a cotton yarn is particularly desirable for the practice of the present invention, the scope of the present invention also includes the use of other suitable materials capable of absorbing a liquid flavorant or other smoke enhancing substance.

Figure 1B:
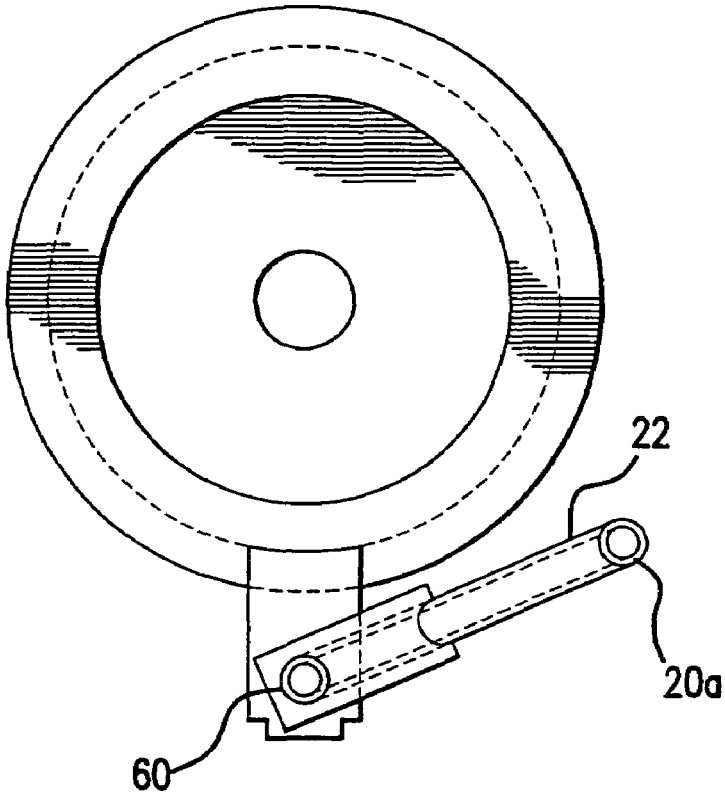
FIG. 1B is an end view of the apparatus shown in FIG. 1A, taken from the inlet end of the apparatus.

The positioning device 20 preferably comprises a non-linear tube having a passageway therethrough and a flavorant introducing attachment secured to a portion of the tube. The flavorant introducing attachment can be connected to the tube at the upstream end of the tube, or at an intermediate position downstream of where the flavor element is introduced. The positioning device 20 is preferably tilted upwards towards its outlet end 20*b*. In the embodiment shown in FIGS. 1A-2, liquid flavorant 60 can be introduced into the positioning device 20 through the second inlet 20*c*. The amount of liquid flavorant 60 introduced into the positioning device can be controlled by a metering pump (not shown). The liquid flavorant collects and forms a bath 60*a* at the low portion 20*d* of the positioning device 20. The liquid flavorant is preferably supplied at a rate which does not overflow at the inlet 20*a* or the outlet 20*b*. The positioning device 20 can be provided with changes in its internal diameter, such as at a converging portion 20*e*, in order to allow for a sufficient volume of liquid flavorant 60 to collect in the bath 60*a* at the low portion 20*d*, while ensuring that the outlet end 20*b* does not have such a large diameter 20*b*" as to interfere with the converging filter tow material before it has been formed into a rod.

Figure 1C:
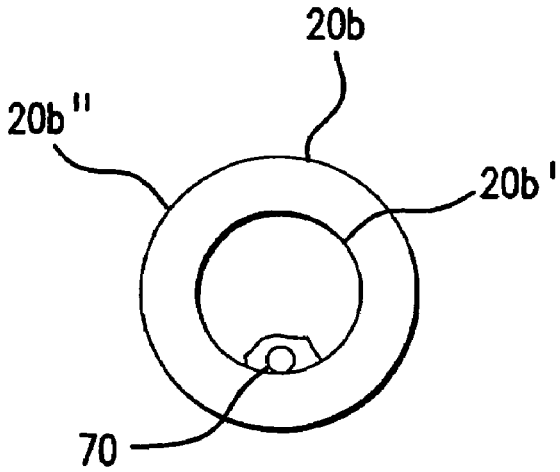
FIG. 1C is an end view of the apparatus shown in FIG. 1A, taken from the outlet end of the apparatus.
Figure 2:
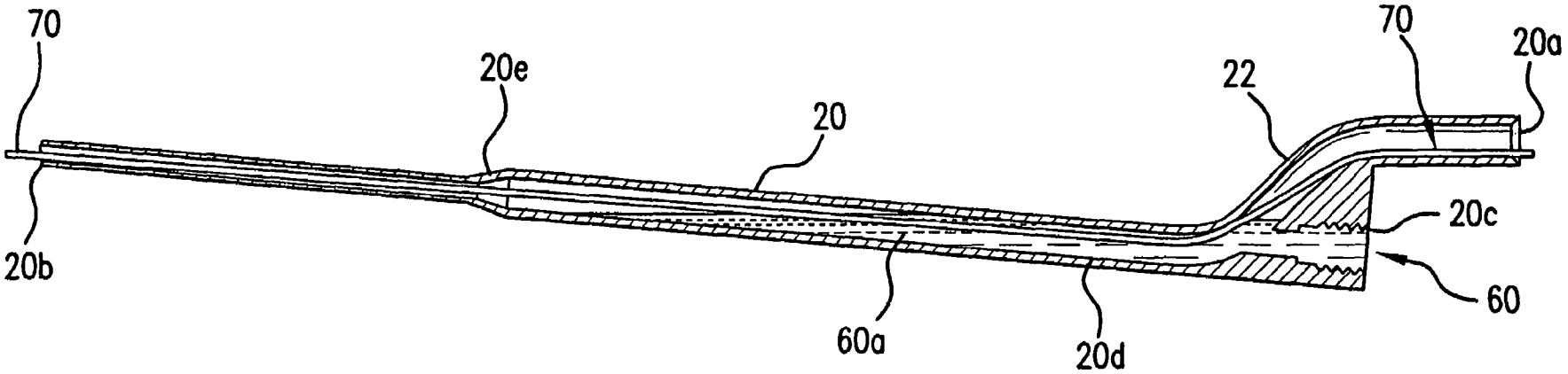
FIG. 2 is a partial sectional view of the positioning device shown in FIG. 1A, showing a bath of liquid flavorant formed in the passageway through the positioning device.

As shown in FIG. 1C, the outlet end 20*b* of the positioning device 20 is provided with a sufficiently large inside diameter 20*b*' such that the continuous flavor element 70 carrying liquid flavorant 60 exits from the outlet end 20*b* at the desired position without creating any undesired back pressure in the positioning device. The flavor element can be provided with a diameter in the range from 0.1-3 mm, and the inside diameter of the outlet end 20*b* can be in the range from 0.5-30 mm, if desired. In a preferred embodiment, the continuous flavor element has a diameter of approximately 0.5 mm, while the inside diameter of the outlet end 20*b* is approximately 3.0 mm in diameter.

Figure 4A:
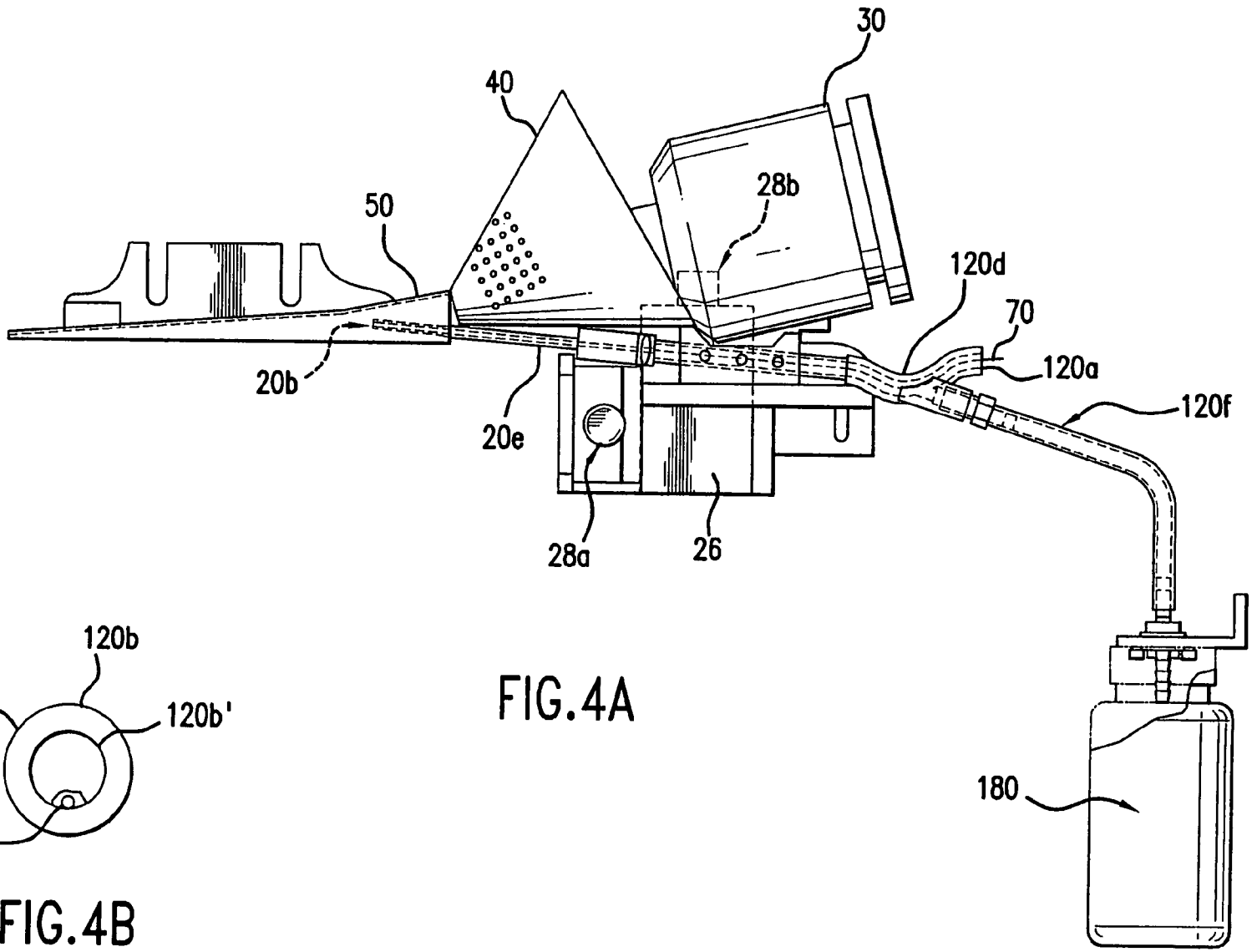
FIGS. 4A and 4B illustrate an apparatus for forming filters including a positioning device according to a second, preferred embodiment of the present invention.
Figure 4B:
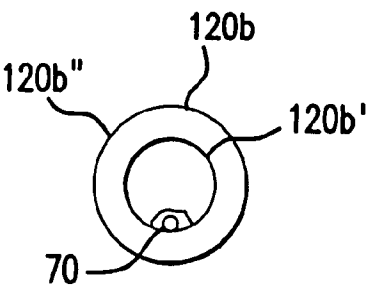
Figure 5A:
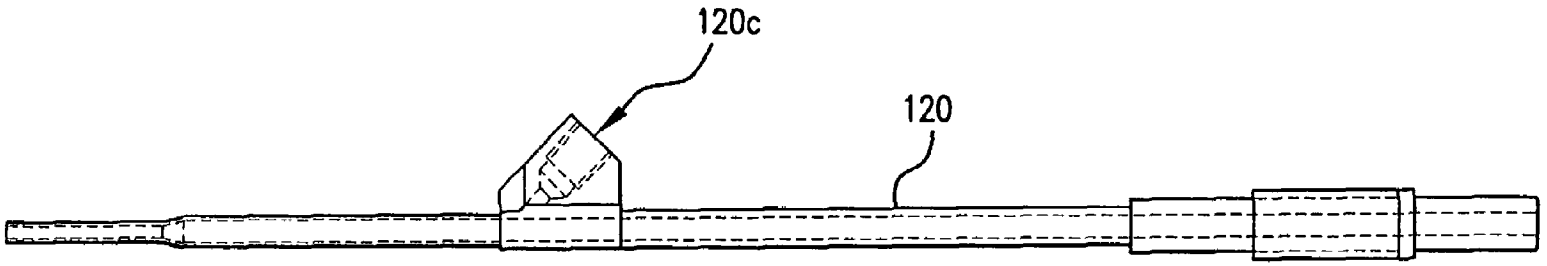
FIGS. 5A-5D illustrate detail views of the positioning device shown in FIGS. 4A and 4B.
Figure 5B:
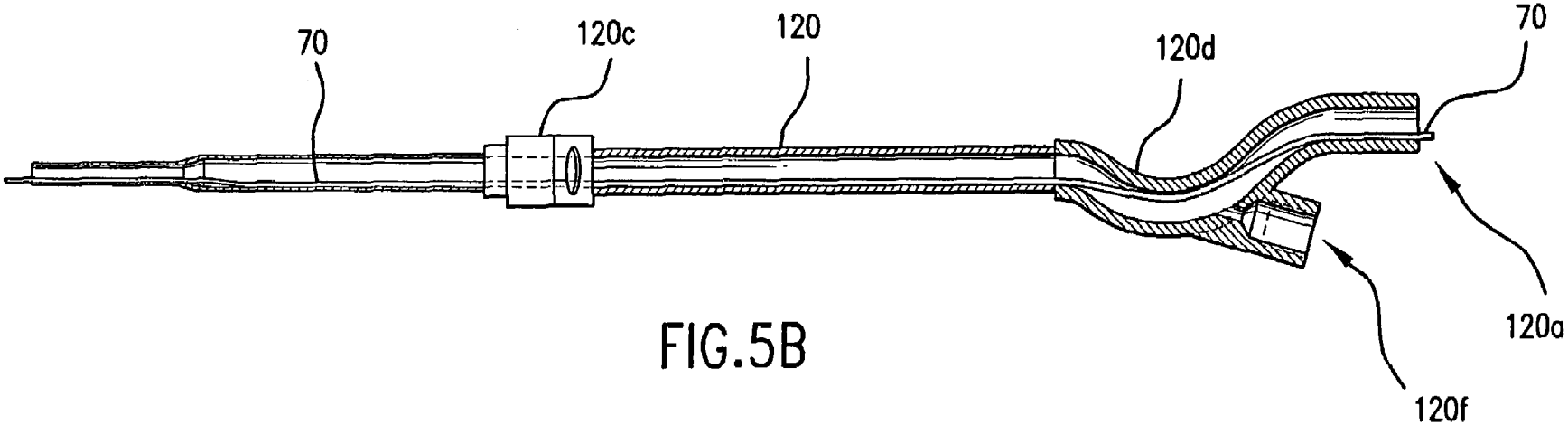
Figure 5C:
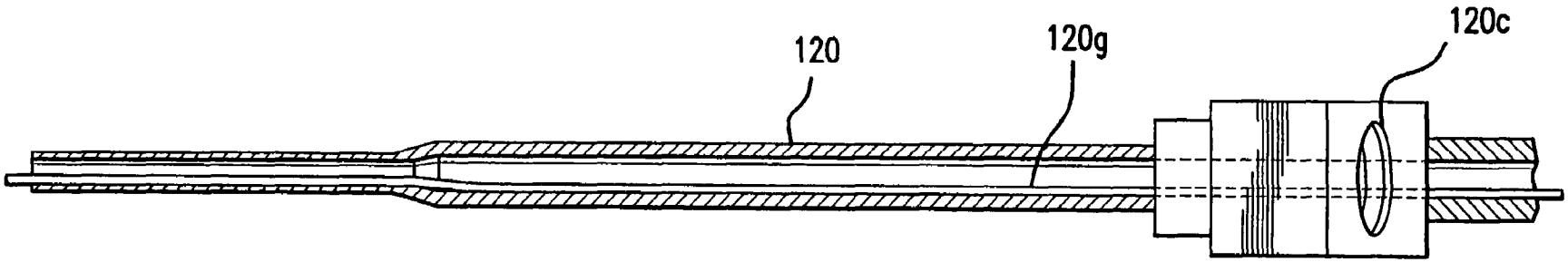
Figure 5D:
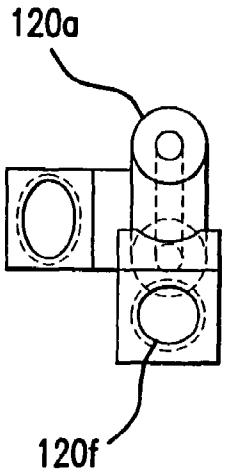

In the embodiment shown in FIGS. 4A-5C, the liquid flavorant is introduced at a downstream position from where the flavor element is introduced. As shown in FIGS. 4A and 4B, the positioning device can be configured with a "goose-neck" portion just downstream of where the flavor element 70 is introduced. This configuration ensures that the flavor element travels along the bottom of the positioning device to the exit. Referring to FIGS. 4A-5D, the illustrated embodiment of the positioning device 120 has an inlet 120*a* for passage of the flavor element 70, a bent or "goose-neck" portion 120*d* with an attached drain 120*f*, a downstream inlet 120*c* for introduction of liquid flavorant 60, and an outlet 120*b*. The continuous flavor element is introduced through inlet 120*a*, and is guided by the goose-neck portion 120*d* so that the flavor element then follows the bottom of the positioning device 120 all the way to the outlet 120*b*, as best seen in FIGS. 5B and 5C. The liquid flavorant 60 is introduced into the positioning device 120 through downstream inlet 120*c* at a rate such that, when equilibrium is reached, the flavor element traveling along the bottom of the passageway through the positioning device partially absorbs and carries all of the flavorant introduced through inlet 120*c* with the flavor element exiting from outlet 120*b* into the path of converging filter tow material. A drain 120*f* can be provided at the end of the device 120 adjacent flavor element inlet 120*a*. Because the device 120 is angled upwards toward outlet 120*b*, the drain 120*f* at the end of device 120 opposite from the outlet end 120*b* is at the lowest point, and provides a means for draining any excess flavorant not carried out of the device 120 by the flavor element. A collecting receptacle 180 can be provided at the end of drain 120*f* to avoid evaporative loss of the excess flavorant.

The filter tow material that is converging through air funnel 40 and underneath the tongue 50 completely surrounds the outlet end 20*b* of the positioning device 20 in the embodiment of FIG. 1A and the outlet end 120*b* of device 120 in FIG. 4A. As the filter tow material continues downstream past the outlet end 20*b*, 120*b*, the tow material pulls along with it the flavor element 70 exiting from the outlet end 20*b*, 120*b*. Bracket 26 and adjustment knobs 28*a*, 28*b*, best seen in FIGS. 3A and 3B, supporting the positioning device 20, 120 allow for accurate positioning of the outlet end 20*b*, 120*b* relative to the converging filter tow material.

As best seen in the end view of FIG. 1B, the inlet end portion 22 of the positioning device 20 used with the embodiment shown in FIGS. 1A-1C can be rotated to a desired angle from vertical in order to achieve the desired clearance between the positioning device 20 and the filter making equipment including transport jet 30 and air funnel 40, or to achieve clearance with the filter material passing into the transport jet. The elevation at the second inlet 20*c* of this embodiment can also be chosen such that liquid flavorant introduced through the inlet 20*c* collects in a bath at the low portion 20*d*, without being urged out of the outlet end 20*b* by an elevation head.

The bracket 26 supporting positioning device 20 can be integrally formed with transport jet 30 and air funnel 40, or it can be otherwise connected thereto using conventional joining techniques. In the embodiment of FIG. 1A, the orientation of the positioning device 20, as controlled by bracket 26 and positioning knobs 28*a*, 28*b*, ensures that a desired amount of liquid flavorant introduced through inlet 20*c* collects in the low portion 20*d* of the positioning device to form a bath 60*a* of the liquid flavorant. The continuous flavor element 70 introduced through inlet 20*a* is then guided into the bath 60*a* by inlet portion 22 of the positioning device 20 such that the liquid flavorant 60 is either partially absorbed by the flavor element 70 and/or clings to it by surface tension as the flavor element 70 exits from the outlet end 20*b* of the positioning device 20. If desired, the positioning device can be provided in other arrangements wherein the passageway includes the bath along the length thereof, or the flavor element removes all liquid flavorant as it is introduced to the device, such that no bath is formed, such as in the embodiment of FIG. 4A.

After the continuous flavor element is partially saturated with liquid flavorant by passing through the bath collected at the low portion 20*d*, or by passing through flavorant being introduced to the positioning device, it is entrained by the converging filter tow downstream from the outlet end 20*b*, 120*b* and incorporated into a continuous rod by the tongue 50. The continuous filter rod can then be cut into desired lengths to form filters or filter segments that each have the flavor element positioned at approximately the center, or any other desired position in the filter rod.

Although embodiments of a filter making apparatus including the positioning device according to the present invention are shown in the figures, the invention is not limited to the described embodiments, and can encompass other arrangements within the scope of the attached claims. The positioning device can be used with filter making apparatus having other arrangements for converging filter tow material into rod form. The positioning device provides for accurate positioning of a flavor element within a filter or filter segment that is formed from filter tow material. As the filter tow material is converged into a finished filter rod, the filter tow material pulls the continuous flavor element carrying liquid flavorant along with it such that the flavor element is positioned in approximately the center of the finished rod. Alternatively, the positioning device can be used to position the continuous flavor element at a different desired position within the finished filter rod. The dimensions and orientation of the positioning device can be modified to provide the bath in arrangements other than the tubular arrangement described above.

What is claimed is:

1. A filter making apparatus, comprising apparatus for producing a fluffed filter tow; a flavor element positioning device in a form of a stationary non-linear tube having a passageway with a first inlet for introducing a continuous flavor element capable of absorbing a liquid flavorant into the passageway, a second inlet for introducing a liquid flavorant into the passageway, and an outlet for positioning the continuous flavor element in the fluffed filter tow as it exits the passageway, said second inlet being in fluid communication with said passageway and positioned downstream of said first inlet, and a first portion of said passageway forming a curved portion adapted to provide a bath of liquid flavorant and to guide the continuous flavor element through the bath of the liquid flavorant in a portion of said passageway downstream of said curved portion.

2. The filter making apparatus according to claim 1, wherein the outlet of said passageway is adapted to be positioned in the path of filter tow material at a point downstream of at least a portion of a converging device that funnels the filter tow material, and at a point upstream of where the filter tow material has formed a rod.

3. The filter making apparatus according to claim 2, further including a drain outlet to remove liquid flavorant at the end of said positioning device opposite from said outlet.

4. The filter making apparatus according to claim 3, wherein said passageway has a variable cross-section including a larger upstream portion of passageway.

5. The filter making apparatus according to claim 4, further including a supporting bracket that adjustably positions said outlet of said positioning device relative to the path of filter tow material.

6. The filter making apparatus according to claim 1, wherein said curved portion is curved convex downward from said first inlet to the bath.

* * * * *